US005166731A

United States Patent [19]

Aimoto et al.

[11] Patent Number: 5,166,731

[45] Date of Patent: Nov. 24, 1992

[54] DEVELOPING UNIT HAVING A ROTATION SHAFT AND SEALING MEMBER

[75] Inventors: Toyoka Aimoto, Nara; Yoshiki Ichikawa, Shiki, both of Japan

[73] Assignee: Sharp Kabushiki Kaisha, Osaka, Japan

[21] Appl. No.: 654,434

[22] Filed: Feb. 12, 1991

[30] Foreign Application Priority Data

Feb. 14, 1990 [JP] Japan ..... 2-34200
Mar. 14, 1990 [JP] Japan ..... 2-65092

[51] Int. Cl.[5] ..... G03G 21/00
[52] U.S. Cl. ..... 355/215
[58] Field of Search ..... 355/200, 215, 245

[56] References Cited

U.S. PATENT DOCUMENTS 4,213,617 7/1980 Salger ..... 355/215 X
4,452,174 6/1984 Fedder ..... 355/245 X
4,506,972 3/1985 Murakami et al. ..... 355/215
4,721,982 1/1988 Ueda ..... 118/657
4,873,940 10/1989 Ishikawa et al. ..... 355/245 X
4,913,448 4/1990 Bhagwat et al. ..... 355/215 X
5,019,861 5/1991 Surti ..... 355/200

FOREIGN PATENT DOCUMENTS 62-143813 9/1987 Japan .

*Primary Examiner*—Fred L. Braun
*Attorney, Agent, or Firm*—David G. Conlin; Robert M. Asher

[57] ABSTRACT

A developing unit for use in an electrophotographic image forming apparatus, which includes a rotation shaft rotatably supported through the wall of the developer tank in such a manner that the gap between the rotation shaft and the supporting wall is sealed with a main sealing member mounted on a bushing holding member, and that the gap between the rotation shaft and the bushing is sealed with a sub-sealing member.

6 Claims, 3 Drawing Sheets

DEVELOPING UNIT HAVING A ROTATION SHAFT AND SEALING MEMBER

BACKGROUND OF THE INVENTION

1. Field of the Invention

The present invention relates to a developing unit used in an electrophotographic image forming apparatus, and more particularly to a developing unit securing the seal between the wall of the developer tank and the rotation shaft passing through the wall of the developer tank.

2. Description of the Prior Art

Referring to FIG. 6, an example of a conventional developing unit used in an electrophotographic image forming apparatus will be described:

The developing unit has a developer tank 10 which contains developer comprising toner and carrier. Inside the developer tank 10, there are rotatably mounted a developing roller 83 for applying the developer to a photosensitive drum 82, a pair of roller stirrers 84, 85 for stirring the developer, an agitator 87 for agitating the toner supplied through a toner supply opening 86, and a magnetic roller 88 for transporting the developer. The toner supplied through the toner supply opening 86 is agitated by the agitator 87 and is then stirred by the roller stirrers 84, 85 for mixing into the developer contained in the developer tank 10. The developer stirred by the roller stirrer 85 is transported to the developing roller 83 which carries the developer on the circumferential surface thereof, the amount of the developer being limited by a doctor blade 91 so that a prescribed amount of developer is applied to the photosensitive drum 82. The developer scraped by the doctor blade 91 is circulated, by means of a baffle plate 92 and the magnetic roller 88, back to the roller stirrer 84 directly or by way of a baffle plate 89.

FIG. 7 shows another example of the developing unit. The developing unit shown comprises a developer tank 10 in which a developing roller 83 for applying the developer to a photosensitive drum 82 and a roller stirrer 84 for stirring the toner supplied by a toner supply roller 97 for mixture into the developer are mounted. The developer stirred by the roller stirrer 84 is distributed to the photosensitive drum 82 by means of the developing roller 83, the amount of the developer carried on the developing roller 83 being limited by a doctor blade 91 so that a prescribed amount of developer is applied to the photosensitive drum 82. The toner density in the developer carried on the developing roller 83 is detected by toner density sensors 95*a*, 95*b*.

In either developing unit, the developing roller 83 which carries the developer on the circumferential surface thereof has a roller member 83*a*, a developer transport member, mounted on a rotation shaft 83*c*, as shown in FIG. 8. Each end of the roller member 83*a* is closed with a flange member 83*b*. On the other hand, as shown in FIG. 9, each of the roller stirrers 84, 85 has a number of stirring vanes 84*a* mounted at an angle on a rotation shaft 20, the stirring vanes 84*a* serving as transport members for axially transporting the developer by stirring. The stirring vanes 84*a* at both ends are mounted at right angles to the rotation shaft 20.

As shown in FIG. 10, the roller stirrers 84, 85 are rotatably supported in a wall 11 of the developer tank 10. That is, the rotation shaft 20 of each of the roller stirrers 84, 85 is rotatably supported in the wall 11 of the developer tank 10 via a bushing 99 formed from sintered material. The bushing 99 rotatably supports the rotation shaft 20, while the gap between the rotation shaft 20 and the bushing 99 is sealed with a sealing member 98. The sealing member 98 comprises a body portion 98*a* mounted in contacting relationship to the rotation shaft 20 and a conically shaped press-contact portion 98*b* gradually increasing in diameter with the distance from the body portion 98*a*. The body portion 98*a* of the sealing member 98 is glued to the stirring vane 84*a* at each end of the roller stirrer 84 (or 85) in such a way that the base of the press-contact portion 98*b* is press-contacted against an end face of the bushing 99. On the end portion of the rotation shaft 20 extending outside the developer tank 10, there is mounted a pulley 21 around which a belt 22 is applied. Driven by a drive unit (not shown), the belt 22 moves in a circular motion to rotate the pulley 21, thereby causing the rotation shaft 20 to rotate.

In such a developing unit, when the rotation shaft 20 is rotated with a radial load P applied to the pulley 21 because of the vibrations or other motion of the driving unit, the rotation shaft 20 may become eccentric with respect to the bushing 99, thus accelerating the wearing thereof. When the rotation shaft 20 becomes eccentric with respect to the bushing 99, the sealing member 98 contacts the bushing 99 unevenly, possibly causing abnormal wear of the sealing member 98. If such wear occurs, adequate sealing cannot be provided between the rotation shaft 20 and the bushing 99, and there is a possibility of developer leakage through the gap between the rotation shaft 20 and the bushing 99. Furthermore, when the bushing bearing 99 is formed from sintered material, the bushing 99 is heated to a high temperature due to friction between the rotation shaft 20 and the bushing 99. In particular, if the rotation shaft 20 becomes eccentric with respect to the bushing 99, the heating by friction will be accelerated and the bushing 99 will be heated to a temperature as high as 100° C. The sealing member 98 is usually made of rubber such as chloroprene rubber. Therefore, when the construction is such that the sealing member 98 directly contacts the bushing 99, the problem is that since the heat is transferred to the sealing member 98, the deterioration of the sealing member 98 is accelerated and the sealing performance thereof drops after a short time of use.

SUMMARY OF THE INVENTION

The developing unit of this invention, which overcomes the above-discussed and numerous other disadvantages and deficiencies of the prior art, comprises a rotation shaft inserted through an opening formed in a wall of a developer tank and to which the power of a drive source is transmitted for rotation, a transport member mounted on the rotation shaft at a portion positioned inside the developer tank so as to transport developer in a predetermined direction in accordance with the rotation of the rotation shaft, the transport member having an end face facing the inner surface of the developer tank, a bushing rotatably supporting the rotation shaft, a bushing holding member fitted on the bushing so as to hold the bushing therein, the bushing holding member holding the bushing in a predetermined relationship with respect to the wall of the developer tank, and a main sealing member mounted on the bushing holding member so as to seal the gap between the rotation shaft and the opening formed in the wall of the developer tank.

In a preferred embodiment, the bushing is formed from a sintered material.

In a preferred embodiment, the bushing holding member is integrally formed with the wall of the developer tank.

In a preferred embodiment, the bushing holding member has a sealing member mounting portion extending from the inner surface of the developer tank into the interior thereof, the main sealing member being mounted on the sealing member mounting portion.

In a preferred embodiment, the main sealing member is press-fitted between the inner surface of the developer tank and the end face of the transport member.

In a preferred embodiment, the main sealing member has a cylindrically shaped body portion mounted in a contacting relationship to the sealing member mounting portion and a conically shaped press-contact portion connected to the body portion and having a progressively increasing diameter with distances away from the body portion.

In a preferred embodiment, the bushing holding member is formed separately form the wall of the developer tank and is movable in the radial direction of the rotation shaft with respect to the opening formed in the wall.

In a preferred embodiment, the main sealing member has a cylindrically shaped body portion mounted in contacting relationship to the bushing holding member and a press-contact portion connected to the body portion and having a progressively increasing diameter with distances away from the body portion, the base of the press-contact portion being constantly press-contacted against the wall of the developer tank.

In a preferred embodiment, the gap between the rotation shaft and the bushing is sealed with a sub-sealing member.

In a preferred embodiment, the sub-sealing member has a cylindrically shaped body portion mounted in a contacting relationship to the rotation shaft and a conically shaped press-contact portion connected to the body portion and having a progressively increasing diameter with distances away from the body portion, the base of the press-contact portion abutting against an end face of the bushing.

Thus, the invention described herein makes possible the objectives of (1) providing a developing unit with no possibility of the sealing member being heated to a high temperature even when the bushing is heated up, thereby preventing the deterioration of the seal member, (2) providing a developing unit with no possibility that the rotation shaft will become eccentric with respect to the bushing, thus assuring the prevention of the wearing and heating of the bushing; and (3) providing a developing unit constructed so as to prevent developer leakage from the developer tank.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Example 1

Figure 1:
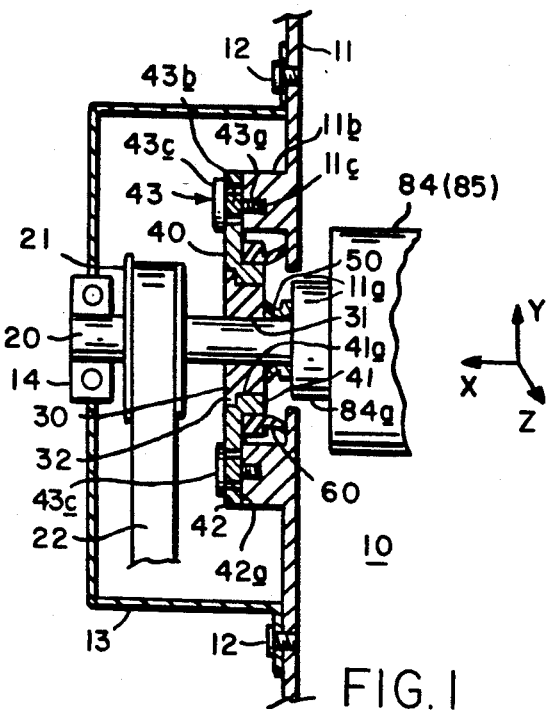
FIG. 1 is a cross sectional view illustrating a first example of a sealing device for a developing unit according to the present invention.
Figure 6:
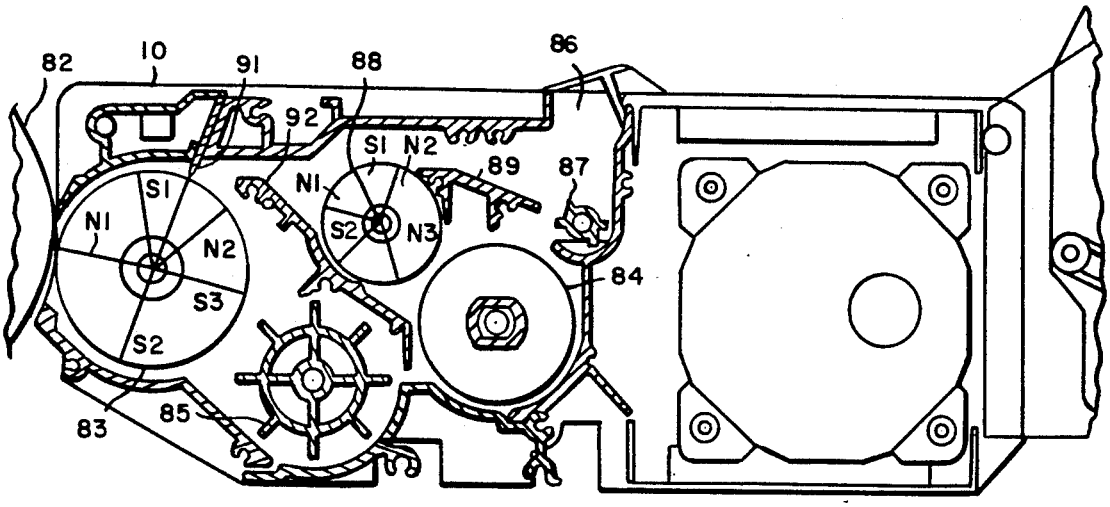
FIG. 6 PRIOR ART
FIG. 6 is a cross sectional view illustrating one example of a developing unit.
Figure 7:
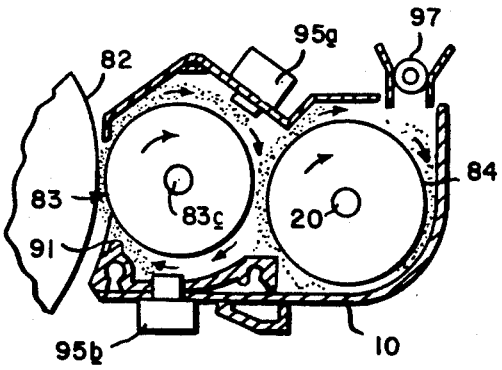
FIG. 7 PRIOR ART
FIG. 7 is a cross sectional view illustrating another example of the developing unit.
Figure 8:
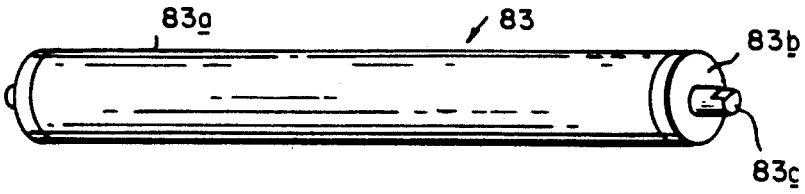
FIG. 8 PRIOR ART
FIG. 8 is a perspective view of a developing roller.
Figure 9:
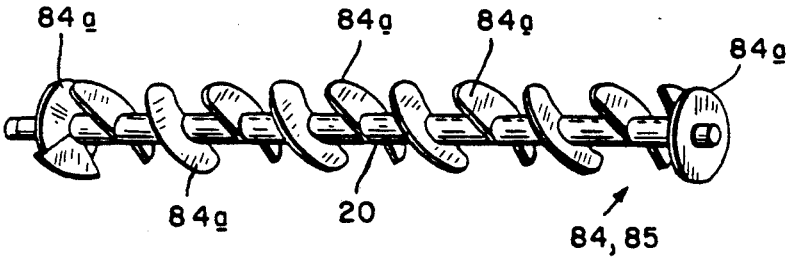
FIG. 9 PRIOR ART
FIG. 9 is a perspective view of a roller stirrer.
Figure 10:
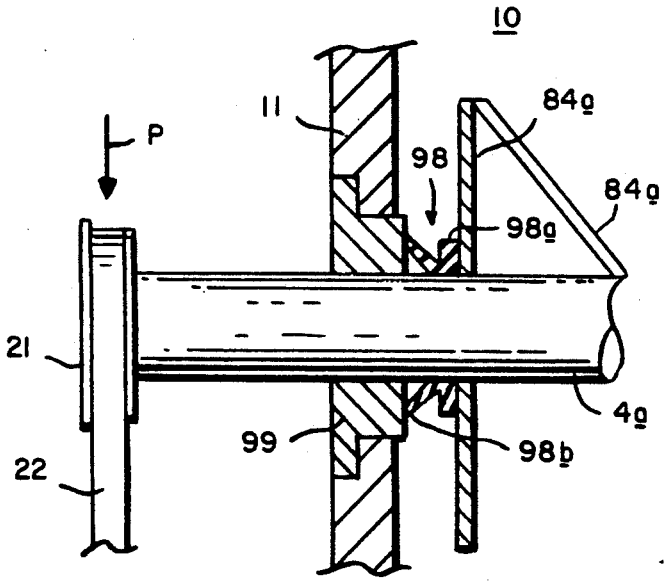
FIG. 10 PRIOR ART
FIG. 10 is a cross sectional view illustrating a prior art example of a sealing device for a developing unit.

The developing unit of the present invention comprises, as does the developing unit shown in FIG. 6, a developing roller 83, roller stirrers 84, 85, an agitator 87, and a magnetic transport roller 88, respectively mounted rotatably in a developer tank 10. As shown in FIG. 1, the roller stirrers 84, 85 are 30 mounted on respective rotation shafts 20. Each rotation shaft 20 is inserted through an opening 11*a* formed in a wall 11 of the developer tank 10. The opening 11*a* is formed so as to provide sufficient clearance around the rotation shaft 20 inserted therethrough so that the rotation shaft 20 does not come into contact with the wall of the opening 11*a* even when the rotation shaft 20 is rotated with a radial load applied thereto. Around the periphery of the opening 11*a* formed in the wall 11 of the developer tank 10, there is formed an annular protrusion 11*b* protruding outwardly of the developer tank 10.

The end portion of the rotation shaft 20 inserted through the opening 11*a* in the wall 11 of the developer tank 10 is rotatably supported via a ball bearing 14 on a reinforcing plate 13 which is fixed to the wall 11 with bolts 12 in such a manner as to cover the opening 11*a*.

A bushing 30 is provided to rotatably support the rotation shaft 20 at the portion positioned inside the protrusion 11*b*. The bushing 30 is formed from cylindrically shaped sintered material having a through hole 31 formed through its axis, and the rotation shaft 20 is rotatably inserted through the through hole 31. The bushing 30 is provided with a flange 32 formed at the farther end thereof from the wall 11 of the developer tank 10.

The bushing 30 is held in a bushing holding member 40 which is joined with a joining means to the protrusion 11*b* on the wall 11 of the developer tank 10. The bushing holding member 40 comprises: a barrel portion 41 having a holding hole 41*a* that firmly contacts the outer circumferential surface of the bushing 30; and a joining portion 42 formed in a flange-like shape at the farther end of the barrel portion 41 from the wall 11 of the developer tank 10. The bushing 30 is fitted in a contacting relationship to the holding hole 41*a* of the barrel portion 41, each end face of the bushing 30 being flush with each end face of the bushing holding member 40.;

The joining portion 42 of the bushing holding member 40 is joined with a joining means to the protrusion 11*b* provided on the wall 11 of the developer tank 10. The joining means comprises: a plurality of through holes 42*a* formed in the joining portion 42 of the bushing holding member 40 in such a manner so as to be appropriately spaced apart form teach other in the circumferential direction of the bushing holding member 40; and a plurality of shoulder screws 43 having a shoulder portion 43*b* of a diameter approximately 1 mm smaller than that of each through hole 42*a*. Each shoulder screw 43 has a threaded portion 43*a* formed forwardly of and having a smaller diameter than the shoulder portion 43*b*, and at the other end, has a head portion 43*c* of diameter larger than that of each through hole 42*a* formed in the joining portion 42. The threaded portion 43*a* of each shoulder screw 43 is screwed and fixed into a screw hole 11*c* formed in the protrusion 11*b* the developer tank 10, thereby fastening the bushing holding member 40 in such a manner as to be movable by approximately 0.1 mm in the axial direction of the rotation shaft 20. Also, since a clearance of approximately 1 mm is provided between the wall of each through hole 42*a* in the joining portion 42 and the shoulder portion 43*b* of each shoulder screw 43, the bushing holding member 40 is movable by approximately 1 mm in the radial direction that intersects at right angles with the axis of the rotation shaft 20 (in the y and z direction when the axial direction of the rotation shaft 20 is denoted as x direction in FIG. 1).

Figure 2:
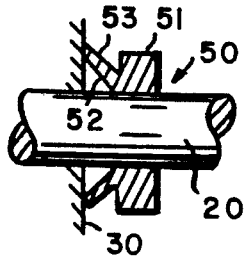
FIG. 2 is an enlarged cross sectional view of a sub-sealing member.

On the rotation shaft 20, a sub-sealing member 50 is disposed for sealing the gap between the rotation shaft 20 and the bushing 30 supporting the rotation shaft 20. The sealing member 50 is formed from rubber such as chloroprene rubber, and comprises, as shown in FIG. 2, a cylindrically shaped body portion 51 and a conically shaped press-contact portion 53 connected via a hinge portion 52 to one end face of the body portion 51 and gradually increasing in diameter toward its base. The sub-sealing member 50 is fitted in such a way that the cylindrically shaped body portion 51 firmly contacts the rotation shaft 20, while the opposite end face thereof from where the press-contact portion 53 is formed is glued to a stirring vane 84*a*, a developer transport member of the roller stirrer 84 (or a stirring member 85), so that the base of the press-contact portion 53 is press-contacted against the end face of the bearing 30.

On the bushing holding member 40 is disposed a main sealing member 60 for sealing the gap between the bushing holding member 40 and the wall 11 of the developer tank 10. The main sealing member 60 is formed from rubber, as is the sub-sealing member 50, and comprises a cylindrically shaped body portion and a press-contact portion connected via a hinge portion to one end face of the body portion and having a V-shaped cross section gradually increasing in diameter toward its base. The main sealing member 60 is fitted in such a way that the cylindrically shaped body portion is glued in contacting relationship to the barrel portion 41 of the bushing holding member 40, while the base of the press-contact portion is press-contacted against the periphery of the opening 11*a* positioned inside the protrusion 11*b* provided on the wall 11 of the developer tank 10.

Between the end portion of the rotation shaft 20 supported by the ball bearing 14 and the portion thereof supported by the bushing 30, a pulley 21 is mounted around which a belt 22 is applied to transmit the power from a drive motor (not shown).

In the developing unit of the above construction, in order to transport the developer in the developer tank 10 with stirring, the drive motor (not shown) is driven and the power of the motor is transmitted to the rotation shaft 20 via the belt 22 and the pulley 21. This works to rotate the rotation shaft 20, causing the roller stirrer 84 (or 85) to rotate.

At this time, when a radial load is applied to the rotation shaft 20 because of the vibrations or other motion of the drive motor, or when a load is applied to the roller stirrer 84 (or 85) because of the developer contained in the developer tank 10, since a clearance is provided between each shoulder screw 43 of the joining means and the wall of each through hole 42*a* in the joining portion 42 so as to allow the bushing holding member 40 supporting the bushing 30 to move freely in the radial direction of the rotation shaft 20, there is no possibility that the rotation shaft 20 will become eccentric with respect to the bushing 30. This prevents wearing between the rotation shaft 20 and the bushing 30, as well as heating being caused by friction between these two members. Also, since the sub-sealing member 50 supporting the rotation shaft 20 moves along with the movement of the portion of the rotation shaft 20 supported by the bushing 30, the slide-contact condition between the bushing 30 and the base of the press-contact portion of the sub-sealing member 50 remains constantly the same. This serves to prevent abnormal wear of the press-contact portion 53 and assures reliable sealing between the rotation shaft 20 and the bushing 30.

The movement of the bushing 30 causes the joining portion 42 of the bushing holding member 40 to slide against the protrusion 11*b* provided on the wall 11 of the developer tank 10, but since the main sealing member 60 mounted on the bushing holding member 40 serves to separate the interior of the developer tank 10 from the sliding surfaces of the bushing holding member 40 and protrusion 11*b*, there is no possibility of developer leakage from the sliding surfaces.

Thus, even when a radial load is applied to the rotation shaft 20, since the bushing 30 is supported movably in the radial direction of the rotation shaft 20 with respect to the wall 11 of the developer tank 10, an excessive load is prevented from being applied to the bushing 30, which serves to prevent the rotation shaft 20, the bushing 30 and other parts from wearing. Also, since the sealing of the developer tank 10 is improved by the provision of the sub-sealing member 50 as well as the main sealing member 60, a reliable prevention is provided against developer leakage from the developer tank 10. Also, since the main sealing member 60 does not directly contact the bushing 30 formed from sintered material, the deterioration of the main sealing member 60 is prevented, thereby assuring stable sealing performance over a long period of time.

Example 2

Figure 3:
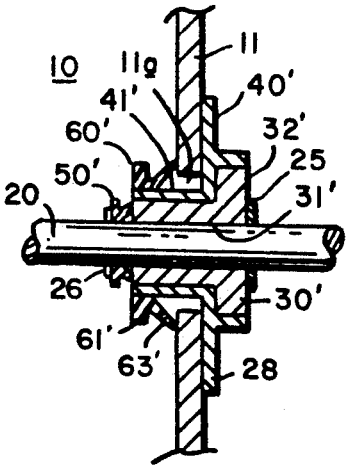
FIG. 3 is a cross sectional view illustrating a second example of a sealing device for a developing unit according to the present invention.
Figure 4:
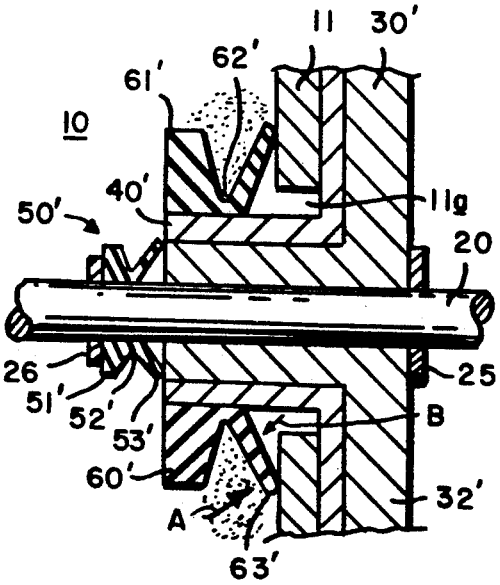
FIG. 4 is an enlarged view of FIG. 3.

FIGS. 3 and 4 show a sealing device for a developing unit in a second example of the present invention In this example also, the rotation shaft 20 of the roller stirrer is inserted through the opening 11*a* formed in the wall 11 of the developer tank 10, with a clearance provided there between, as in the foregoing example. In this example, a bushing 30′ is provided to support the rotation shaft 20 at the portion positioned inside the opening 11*a*. The bushing 30′ is also formed form a cylindrically shaped sintered material having a through hole 31′ formed through its axis, and is provided with a flange 32′ at one end thereof. The flange 32′ of the bushing 30′ is positioned outside of the developer tank and an E-ring 25 fitted in the rotation shaft 20 is abutted against the end face of the flange 32′.

The bushing 30′ is held in a bearing holding member 40′. The bushing holding member 40′ comprises: a stepped barrel portion 41′ that is fitted in contacting relationship to the outer circumferential surface of the bushing 30′; and a mounting portion 42′ formed in a flange-like shape extending outwardly of the stepped portion of the stepped barrel portion 41′. The bushing 30′ is fitted in the bearing holding member 40′ in such a way that each end face of the bushing 30′ comes flush with each end face of the barrel portion 41′. The mounting portion 42′ is positioned slidably against the outer periphery of the opening 11*a*.

The gap between the rotation shaft 20 and the bushing 30′ is sealed with a sub-sealing member 50′. Like the sub-sealing member 50 of the foregoing example 1, the sub-sealing member 50′ comprises a cylindrically shaped body portion 51′ and a conically shaped press-contact portion 53′ connected via a hinge portion 52′ to one end face of the body portion 51′ and gradually increasing in diameter toward its base, these portions being integrally formed from chloroprene rubber. The sub-sealing member 50′ is fitted in such a way that the cylindrically shaped body portion 51′ firmly contacts the rotation shaft 20, while the opposite end face thereof from where the press-contact portion 53′ is formed is press-contacted against the E-ring 26 fitted in the rotation shaft 20 so that the base of the press-contact portion 53′ is press-contacted against the end face of the bushing 30′ positioned in the developer tank 10. A groove portion having a V-shaped cross section is formed between the press-contact portion 53′ and the body portion 51′. The base of the press-contact portion 53′ is urged by its own elasticity in the direction in which the diameter decreases.

On the end portion of the cylinder 41′ of the bushing holding member 40′ positioned inside the developer tank 10, there is provided a main sealing member 60′ for sealing the gap between the bushing holding member 40′ and the wall 11 of the developer tank 10. The main sealing member 60′ comprises, as does the sub-sealing member 50′, a cylindrically shaped body portion 61′ and a conically shaped press-contact portion 63′ connected via a hinge portion 62′ to one end face of the body portion 61′ and gradually increasing in diameter toward its base, these portions being integrally formed from chloroprene rubber. The main sealing member 60′ is fitted in such a way that the cylindrically shaped body portion 61′ firmly contacts the rotation shaft 20, while the base of the press-contact portion 63′ is press-contacted against the inner surface of the wall 11 of the developer tank 10. The main sealing member 60′ is also provided with a groove portion having a V-shaped cross section between the press-contact portion 63′ and the body portion 61′. The base of the press-contact portion 63′ is urged by its own elasticity in the direction in which the diameter decreases. The main sealing member 60′ provides, for example, a withstanding pressure of 0.5 kg/cm$^2$ in the direction indicated by arrow A in FIG. 4, and a withstanding pressure of 0.025 kg/cm$^2$ in the direction indicated by arrow B.

In the developing unit of the above construction, a pulley is mounted on the portion of the rotation shaft 20 extending outside the developer tank 10, and the power of the drive motor is transmitted to the pulley. By rotating the rotation shaft 20, the roller stirrer is rotated to stir the developer in the developer tank 10.

In this example also, when a radial load is applied to the rotation shaft 20 by the vibrations of the motor, the load of the developer applied to the roller stirrer 4, or by other force, since the bushing holding member 40′ holding the bushing 30′ can move freely in the radial direction of rotation shaft 20 with respect to the wall 11 of the developer tank 10, there is no possibility that the rotation shaft 20 will become eccentric with respect to the bushing 30′. This prevents wearing between the rotation shaft 20 and the bushing 30′, as well as heating from being caused by friction between these two members. Also, since the bushing 30′ supporting the rotation shaft 20 moves along with movement of the rotation shaft 20 and the sub-sealing member 50′ mounted on the rotation shaft 20 also moves in a likewise manner, the slide-contact condition between the bushing 30′ and the base of the press-contact portion 53′ of the sub-sealing member 50′ remains constantly the same. This serves to prevent abnormal wear of the press-contact portion 53′ and assures reliable sealing between the rotation shaft 20 and the bushing 30′.

The movement of the bushing 30′ causes the bushing holding member 40′ to slide against the wall 11 of the developer tank 10, but since the main sealing member 60′ mounted on the bushing holding member 40′ contacts the wall 11 of the developer tank 10 so as to seal the periphery of the opening 11*a* in the wall 11, there is no possibility of developer leakage from the opening 11*a*. Furthermore, since the main sealing member 60′ is mounted on the bushing holding member 40′ so as not to directly contact the bushing 30′, the transmission of the frictional heat generated in the bushing 30′ is prevented, thereby preventing the main sealing member from being deteriorated by heat. Since the developer is deposited in the groove portion between the body portion 61′ and the press-contact portion 63′, the press-contact portion 63′ is strongly pressed onto the wall surface of the developer tank 10, the sealing performance of the main sealing member 60′ is further enhanced.

Example 3

Figure 5:
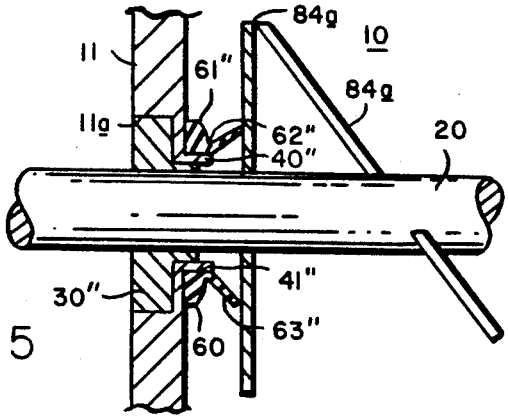
FIG. 5 is a cross sectional view illustrating a third example of a sealing device for a developing unit according to the present invention.

FIG. 5 shows a sealing device for a developing unit in a third example of the present invention. In this example, a bushing 30″ that supports the rotation shaft 20 is fitted in such a way as to allow free rotation of the rotation shaft 20, and a bushing holding member 40″ that holds the bushing 30″ is formed integrally with the wall 11 of the developer tank 10. The bushing holding member 40″ comprises: an opening 11*a* formed in the wall 11 and sized to firmly fit the outer circumferential surface of the bushing 30″; and a cylindrically shaped sealing member mounting portion 41″ extending along the axis of the opening 11*a* into the interior of the developer tank 10. A main sealing member 60″ is mounted on the sealing member mounting portion 41″. The main sealing member 60″ consists of a cylindrically shaped body portion 61″ and a conically shaped press-contact portion 63″ connected via a hinge portion 62″ to one end face of the body portion 61″ and gradually increasing in diameter toward its base, these portions being integrally formed from chloroprene rubber. The main sealing member 60″ is fitted in such a way that the cylindrically shaped body portion 61″ firmly contacts the sealing member mounting portion 41″. At the same time, the main sealing member 60″ is press-contacted against a stirring vane 84*a*, an end face of a transport member on the roller stirrer 84 mounted on the rotation shaft 20, so that an end face of the body portion 61″ and the base of the press-contact portion 63″ are press-contacted against the inner surface of the developer tank 10 and the stirring vane 84*a*, respectively.

In this example, even when the bushing 30″ is heated by frictional heat because of a radial load applied to the rotation shaft 20 and resultant unevenness in the frictional force between the rotation shaft 20 and the bushing 30″ in the rotating direction of the rotation shaft 20, the interposition of the sealing member mounting portion 41″ of the bushing holding member 40″ between the bushing 30″ and the main sealing member 60″ serves to prevent the transmission of heat to the main sealing member 60″. The main sealing member 60″ is heated as a result of the friction of the press-contact portion 63″ against the end face of the stirring vane 84*a*, a transport member mounted on the rotation shaft 20. However, since developer is deposited in the groove having a V-shaped cross section formed between the press-contact portion 63″ and the body portion 61″, the heat in the main sealing member 60″ is dissipated through the developer, thereby protecting the main sealing member 60″ against becoming heated to a high temperature. Thus, the rubber-made main sealing member 60″ maintains its working condition over a long period of use.

The present invention is also applicable to other cases such as providing sealing between the wall of the developer tank and the rotation shaft of the developing roller mounted inside the developer tank.

It is understood that various other modifications will be apparent to and can be readily made by those skilled in the art without departing from the scope and spirit of this invention. Accordingly, it is not intended that the scope of the claims appended hereto be limited to description as set forth herein, but rather that the claims be construed as encompassing all the features of patentable novelty that reside in the present invention, including all features that would be treated as equivalents thereof by those skilled in the art to which this invention pertains.

What is claimed is:

1. A developing unit for use in an electrophotographic image forming apparatus, the developing unit comprising:

a rotation shaft inserted through an opening formed in a wall of a developer tank and to which the power of a driver source is transmitted for rotation, a transport member mounted on the rotation shaft at a portion positioned inside the developer tank so a to transport developer in a predetermined direction in accordance with the rotation of the rotation shaft, the transport member having an end face facing the inner surface of the developer tank, a bushing rotatably supporting the rotation shaft therein, a bushing holding member which is fixedly fitted into the bushing so as to hold the bushing therein, wherein said bushing holding member is formed separately from the wall of the developer tank and is movable in the radial direction of the rotation shaft with respect to the opening formed in the wall, a sealing main member mounted on the bushing holding member so as to seal a gap between the rotation shaft and the opening formed in the wall of the developer tank.

2. A developer unit according to claim 1, wherein the main sealing member has a cylindrically shaped body portion mounted in contacting relationship to the bushing holding member and a press-contact portion connected to the body portion and having a progressively increasing diameter with distances away from the body portion, the base of the press-contact portion being constantly press-contacted against the wall of the developer tank.

3. A developing unit according to claim 1, wherein the gap between the rotation shaft and the bushing is sealed with a sub-sealing member.

4. A developing unit according to claim 3, wherein the sub-sealing member has a cylindrically shaped body portion mounted in contacting relationship to the rotation shaft and a conically shaped press-contact portion connected to the body portion and having a progressively increasing diameter with distances away from the body portion, the base of the press-contact portion abutting against an end face of the bushing.

5. A developing unit for use in an electrophotographic image forming apparatus, the developing unit comprising:

a rotation shaft inserted through an opening formed in a wall of a developer tank and to which the power of a driver source is transmitted for rotation, a transport member mounted on the rotation shaft at a portion positioned inside the developer tank so as to transport developer in a predetermined direction in accordance with the rotation of the rotation shaft, the transport member having an end face facing the inner surface of the developer tank a bushing rotatably supporting the rotation shaft therein, a bushing holding member which is fixedly fitted on the bushing so as to hold the bushing therein, wherein said bushing holding member is fixedly provided in the wall of the developer tank, holds the bushing in a predetermined relationship with respect to the wall of the developer tank, and has a sealing member mounting portion extending from the inner surface of the developer tank into the interior thereof; and a main sealing member which is mounted on the bushing holding member so as to seal a gap between the rotation shaft and the opening formed in the wall of the developer tank and is press-fitted between the inner surface of the developer tank and the end face of the transport member, wherein the main sealing member has a cylindrically shaped body portion mounted in a contacting relationship to the sealing member mounting portion and a conically shaped press-contact portion connected to the body portion and having a progressively increasing diameter with distances away from the body portion.

6. A developing unit according to claim 5, wherein the bushing is formed from sintered material.

* * * * *